United States Patent [19]

Bebel

[11] Patent Number: 4,918,428

[45] Date of Patent: Apr. 17, 1990

[54] TWO DIMENSIONAL NUMERICAL DISPLAY WITH TREAD INDICATOR

[75] Inventor: Joseph Bebel, Howell, N.J.

[73] Assignee: Ametek, Inc., New York, N.Y.

[21] Appl. No.: 172,002

[22] Filed: Mar. 22, 1988

[51] Int. Cl.[4] ..... G09G 3/04

[52] U.S. Cl. ..... 340/756; 340/753; 340/765

[58] Field of Search ..... 340/752, 753, 754, 756, 340/759, 765; 350/336

[56] References Cited

U.S. PATENT DOCUMENTS 4,240,074 12/1980 Gibson et al. ..... 340/753

4,270,196 5/1981 Terzian ..... 340/756

*Primary Examiner*—Jeffery A. Brier

*Attorney, Agent, or Firm*—Amster, Rothstein & Ebenstein

[57] ABSTRACT

A planar solid state LCD display for presenting numeric information comprises six generally rectangular arrays of segments arranged in ladder-like disposition with the outermost rectangles being of progressively decreasing height. The segments are selectively energizable to present multiple 7 segment digit displays wherein a digit has maximum height when centered and a reduced height when above or below the centered position. This provides to a viewer a perception which simulates the rotation of rolling of a digit wheel of conventional counter type wherein the trend of rotation is observable.

11 Claims, 6 Drawing Sheets

Fig. 13.

| Display | 58 | 54 | 56 | 52 | 48 | 50 | 34 | 40 | 42 | 36 | 44 | 46 | 38 | 60 | 62 | 68 | 64 | 66 | 70 |
|---|---|---|---|---|---|---|---|---|---|---|---|---|---|---|---|---|---|---|---|
| 0 | X | | X | X | | | X | X | X | | X | X | X | | | | | X | |
| 1 | X | | | X | X | X | | X | X | X | | | | | X | | | X | |
| 2 | X | X | X | | X | X | X | | | | | X | | | X | X | | | X |
| | | X | X | | | | X | | X | | | X | X | | X | X | | X | X |
| | | X | X | | | | | | | | | | X | X | | X | | | X |
| | | | | | | | | | | X | | X | X | X | | X | | | X |
| | | | X | | | X | | | | X | | | X | | | X | | | X |
| | | | X | | | X | | | | X | | | X | | | X | | | X |

Fig. 14.

| Fig | Display | 45 | 41 | 37 | 35 | 39 | 43 |
|---|---|---|---|---|---|---|---|
| 5 | 0 | X | | X | X | | X |
| 6 | | X | X | | X | X | |
| 7 | | | X | X | | X | X |
| 8 | 1 | X | | X | X | | X |
| 9 | | X | X | | X | X | |
| 10 | | | X | X | | X | X |
| 11 | 2 | X | | X | X | | X |

TWO DIMENSIONAL NUMERICAL DISPLAY WITH TREAD INDICATOR

FIELD OF THE INVENTION

The present invention relates generally to solid state planar displays such as liquid crystal displays (LCD) and light emitting diode displays (LED) used for numerically presenting information.

BACKGROUND OF THE INVENTION

It is currently conventional to utilize LCD and LED displays in an almost infinite variety of applications to present information in numeric form. This is particularly true with respect to instrumentation of virtually all types. Such planar displays are inherently two dimensional.

Prior to the advent of planar solid state displays, such as LCD and LED by way of example, it was long the practice to present numeric information in instrumentation through the use of mechanical counter wheels or drums such as found for example in Veeder-Root counters of the type utilized in automobile odometers, engine hour meters and the like. While these displays may popularly be perceived to be two dimensional, they are in fact three dimensional by virtue of their use of cylindrical wheels or drums. With such an arrangement the figures on the wheels can be seen advancing in the instrument display window in one direction or the other. As a result the viewer can perceive a trend in the direction of the readout either up or down. Instrumentation of this type is common in automobiles, aircraft, boats, etc.

SUMMARY OF THE INVENTION

The present invention provides a unique technique and apparatus to present a flat screen LCD two dimensional digital presentation which simulates and provides visual perception of a mechanical wheel type display wherein the figures can be seen advancing into and receding from the display window to permit trend observation.

It is accordingly an object of the present invention to provide a planar digital display using two dimensional solid state digital display devices wherein the display appears to be three dimensional.

It is another object of the invention to provide a unique two dimensional LCD display so constructed as to present to a viewer the perception of a three dimensional odometer type readout.

According to the invention there is provided a solid state display device such as an LCD display on a substantially planar support. The display includes multiple energizable display elements disposed to form substantially rectilinear segments arranged to define trapezoids of substantially rectangular shape. The rectangles are arranged one atop the other in a generally ladder-like configuration having parallel common segments between adjacent rectangles. The center two rectangles are of substantially equal size. The rectangles above and below the center rectangles are of increasingly diminishing height. In a specific embodiment the configuration comprises a pair of center rectangles with two additional rectangles disposed above and below each of the center rectangles. The segments in each adjacent pair of rectangles are selectively energizable to display digits wherein the digits have a maximum height when formed by the segments of the center pair of rectangles, a second lesser height when the digit is formed by a central rectangle and an adjacent rectangle, and a third lesser height when said digit is formed by adjacent rectangles not including a central rectangle.

According to another feature of the invention the successive rectangles above and below the central pair may decrease not only in height but also in width. Still further, the segments forming the parallel segments in the ladder-like configuration may be of decreasing width as they are removed farther and farther from the center of the configuration of rectangles. The result of the selective energization of segments of the various sets of rectangles provides to a viewer a perception which simulates the rotation or rolling of a digit wheel of the conventional counter type instrument wherein the trend of rotation is observable.

The display device of the invention may comprise a dichroic LCD display device having a substantially planar support carrying multiple 7 segment digit displays having common horizontal segments. These parallel segments in combination with vertical segments provide 6 generally rectangular arrays. The rectangular arrays comprise a central pair of rectangles having vertical segments of equal length or height. Adjacent to these central rectangles are first additional rectangles disposed above and below the central rectangles and having vertical segments with a length or height less than the length or height of the vertical segments in the central rectangles. Disposed above and below these first additional rectangles are second additional rectangles having vertical segments with a length or height less than the length or height of the vertical segments in the first additional rectangles. The segments in each adjacent pair of rectangles are selectively energizable to display digits or portions thereof. Such digits have a first maximum vertical height when formed by the segments of the central pair of rectangles, a second vertical height when formed by a central rectangle and a first additional rectangle, and a third vertical height when formed by a first additional rectangle and a second additional rectangle. The third height is less than the second height and the second height is less than the first height.

A display of this type may be used to provide a readout for a transponder or transducer which produces an analog voltage or current indicative of a parameter being measured such as automotive speed or aircraft altitude. The transponder or transducer may be connected to an analog-to-digital converter and thence to a controller for feeding a decoder driver to drive the LCD display.

The display permits the presentation of the appearance of a three dimensional disk or drum type readout using planar LCD devices. The invention permits taking advantage of the propensity for observers conditioned by the use of such disk or drum type readouts to read trends and sense information in addition to that which would be presented by a simple digital display of the instant or current value of a parameter. According to the invention this is accomplished with minimal display area and circuitry. The result provides enhanced communication of information and increased utility of the instrument.

The foregoing and other objects and advantages of the present invention will be apparent to those skilled in the art from the following specification, claims and drawings.

BRIEF DESCRIPTION OF THE DRAWINGS

FIG. 13 is a table showing energzation of segments to change the display; and FIG. 14 is a table showing energization of rectangles of the display to advance the display.

DETAILED DESCRIPTION OF THE PREFERRED EMBODIMENT OF THE INVENTION

Figure 1:
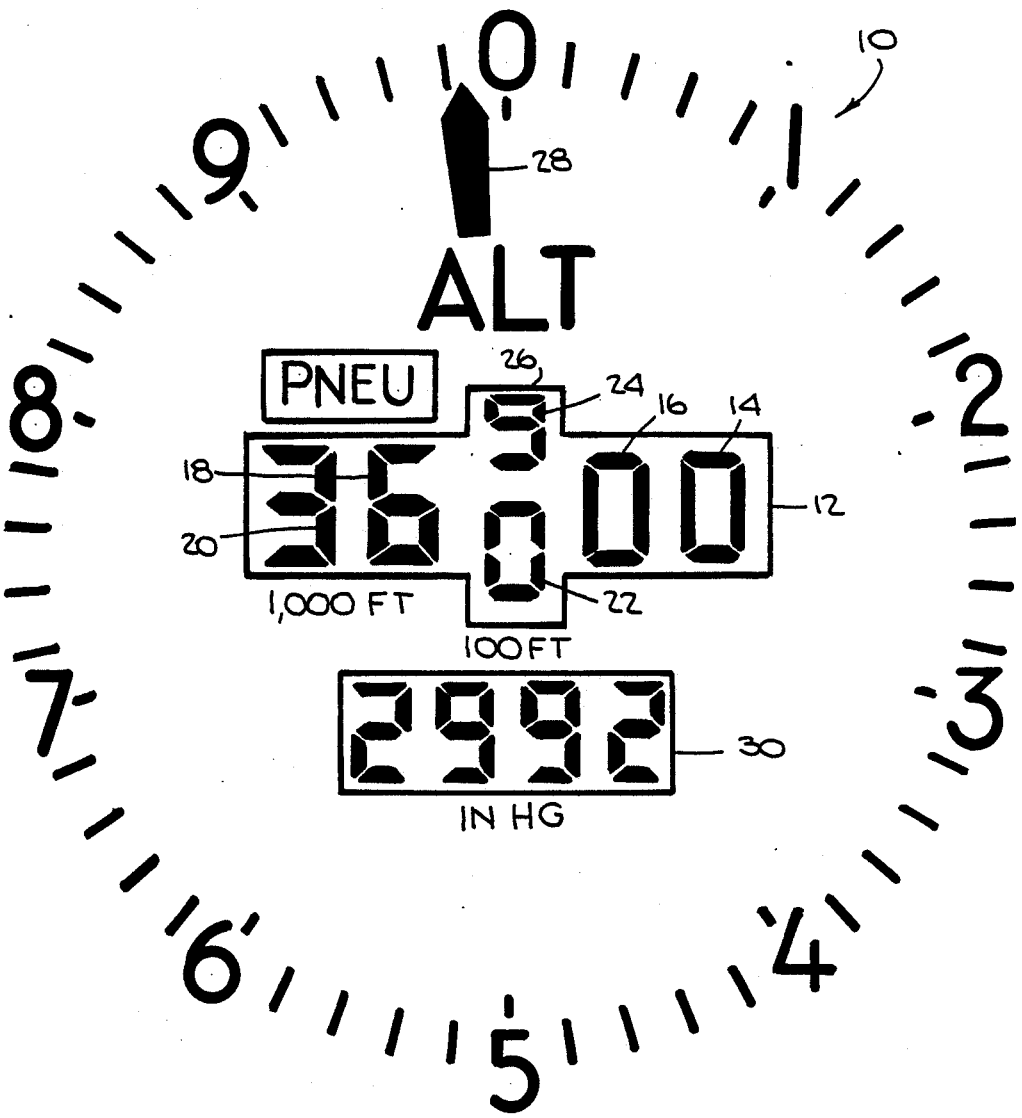
FIG. 1 is a front elevational view of a depiction of the face of an altimeter utilizing the LCD digit presentation of the invention for the hundreds display.

Referring to FIG. 1 there is shown the face 10 of an altimeter having an altitude display window showing altitude in feet. The units and tens digits 14 and 16 are fixed zero marks and may be printed or the like. The thousands and ten thousands digits 18 and 20 are presented by conventional LCD displays. The hundreds digit is presented in the center of the window 12 by means of the invention. This simulates the rolling or advance of a wheel or drum as indicated by the display of the 0 digit at 22 and the compressed display of the 9 digit at 24.

The drum-like odometer type display of the hundreds digit is provided through a wider central window portion 26. This permits viewing of the expanded LCD display area associated with the display of the invention. A hundreds altimeter pointer 28 may be provided along with a readout of atmospheric pressure in inches of Mercury as indicated at 30. The altimeter pointer 28 and atmospheric pressure indicator 30 may constitute LCD displays. A dichroic LCD display common to all indicators 18, 20, 26, 28 and 30 may be provided such that the dial is screened so as to expose only the digits and pointer required for the particular indications.

In viewing conventional mechanical wheel or drum type instrument readouts it is possible for the observer to notice a trend of increase or decrease in the reading in increments of less than a digit. By reason of long experience with this type of presentation observers such as pilots obtain a lesser amount of information from observation of conventional digital LCD displays. The device of this invention makes it possible to present to the observer the same information content as the three dimensional wheel or drum type instrument while utilizing two dimensional LCD displays.

Figure 2:
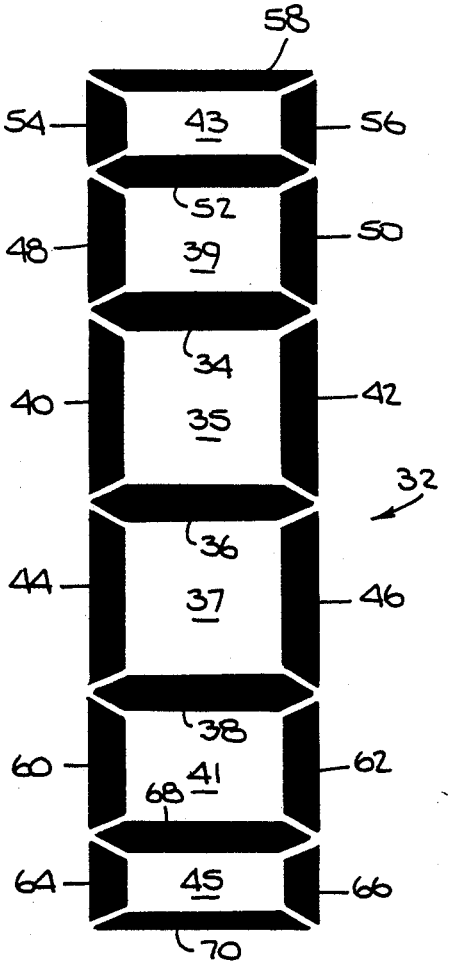
FIG. 2 shows an LCD display of the invention with all display segments energized.

Referring to FIG. 2 there is shown an LCD display constructed according to a preferred embodiment of the invention. This display comprises a dichroic LCD having the usual digit indicated at 32 formed of the 7 segments 34–46. The segments are equal in width, the vertical segments are equal in length and the horizontal segments are equal in length. It will be understood that the segments may be unitary as illustrated or may be comprised of point displays or less than segment length elements to collectively form the segments.

The central 7 segment display 32 defines the conventional double rectangle 7 segment display configuration which is referred to herein as a pair of central or center rectangles. It will be understood that this reference is for purpose of convenience and that precise or complete rectangles are not required. Thus it is obvious from FIG. 2 that the various segments 34–46 of the 7 segment display are spaced at their end portions and that such spacing may be varied so that the "rectangle" is more or less complete likewise the term rectangle is used herein for convenience without requirement that it be restricted to a geometrically true rectangle.

Above the uppermost horizontal segment 34 of the upper central rectangle there are provided vertical segments 48 and 50 of the same width as vertical segments 40–46 but of a shorter height. Above the vertical segments 48 and 50 there is provided a horizontal segment 52 of the same length as horizontal segments 34–38 but of a lesser width. Above horizontal segment 52 there are provided vertical segments 54 and 56 having the same width as the other vertical segments 40–50 but having a shorter length than vertical segments 48 and 50 which are immediately therebelow. Atop segments 54 and 56 there is provided a final horizontal segment 58. This segment 58 has the appearance of a half segment in terms of the shape of its triangular ends and its width. Top segment 58 has a width less than the width of the next lower horizontal segment 52.

At the lower end of the LCD display of FIG. 2 below the central rectangles there are provided vertical segments 60–66, horizontal segment 68 and horizontal half segment 70. These segments constitute a mirror image of upper segments 48–58 just described. It will be seen that the display in FIG. 2 defines the central rectangles 35 and 37 which are of equal size and mirror images of one another. Above and below the central rectangles 35 and 37 are first additional rectangles 39 and 41 formed with vertical segments with a height less than the height of the vertical segments of the central rectangles. Disposed above and below these first additional rectangles 39 and 41 are second additional rectangles 43 and 45 having vertical segments with a height less than the height of the vertical segments of the first additional rectangles 39 and 41.

The six rectangles 35, 37, 39, 41, 43 and 45 are arranged one atop the other in a generally ladder-like configuration having parallel common segments 34, 36, 38, 52 and 68 between adjacent rectangles The upper half of the overall configuration is a mirror image of the lower half. This configuration permits selective energization of the various segments to present 7 segment displays comprised of five different combinations of adjacent rectangles, such as 41–45, 41–37, 37–35, 35–39 and 39–43. Thus with this arrangement a complete digit may be displayed in 5 different positions and may be made to move sequentially through such positions in step-wise fashion. A digit may also be made to appear to move off scale so that less than a complete digit is in view. This arrangement permits simulation of a wheel or drum type digit display and tends to create the same type psychological perception and reaction.

Figure 5:
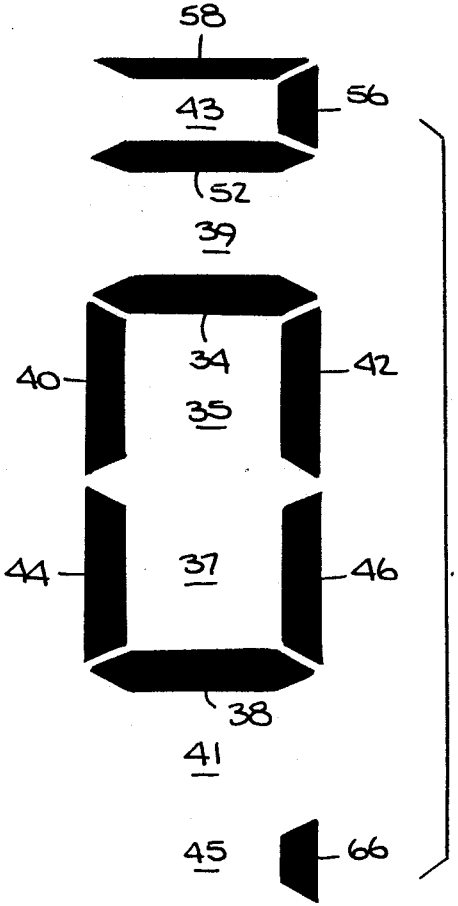

Referring to FIGS. 5–11 there is pictorially depicted the advance of a digital display according to the invention from digit 0 to digit 1 to digit 2. Using the same segment reference numerals as described in connection with FIG. 2 that sequence may be described as follows:

In FIG. 5 segments 58, 56, 52, 34, 40, 42, 44, 46, 38 and 66 are energized. The digit 0 is centered and of a full or maximum size or height. A shortened upper portion of the digit 1 indicated as segment 66 appears at the bottom of the display. At the top of the display the lower half of the digit 9 appears to move upwardly out of view as segments 52, 56 and 58. In FIG. 5 the central rectangles 35 and 37 are energized to present a full sized maximum height 7 segment display. The first additional rectangles 39 and 41 (as represented by the vertical segments thereof) are deenergized to present the appearance of space between the respective digits as on a wheel or drum and the second additional rectangles 43 and 45 are energized. It will be noted that the parallel horizontal segments are always subject to energization depending upon the particular digit being displayed.

Figure 6:
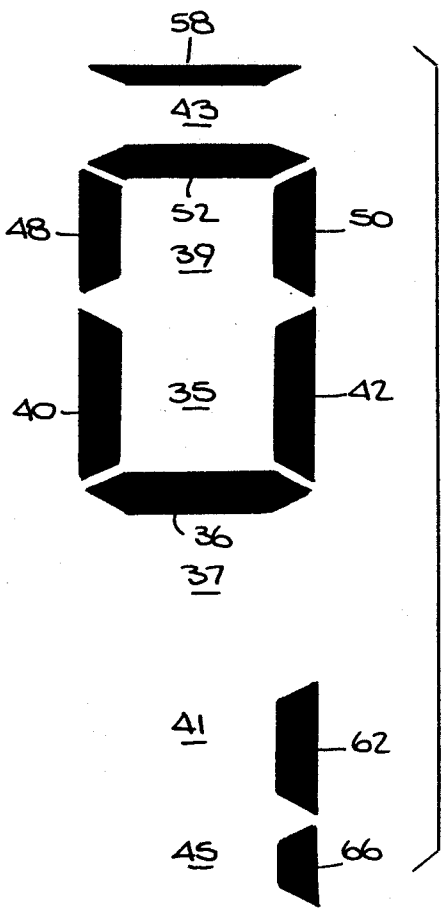

In FIG. 6 the digit 0 has moved upwardly with its upper half becoming foreshortened in the form of segments 48, 50 and 52. The lower half of the digit 9 has moved upwardly even farther out of view and is represented only by segment 58. At the bottom of the display the digit 1 has moved farther upwardly into view as an entire but foreshortened digit comprised by segments 62 and 66. In FIG. 6 rectangles 45, 41, 35 and 39 are energized and rectangles 37 and 43 are not energized (as represented by the vertical segments thereof). In FIG. 6 two 7 segment displays are energized to present in their entirety the digits 0 and 1. These 7 segment displays are comprised of rectangles 39–35 and 41–45.

Figure 7:
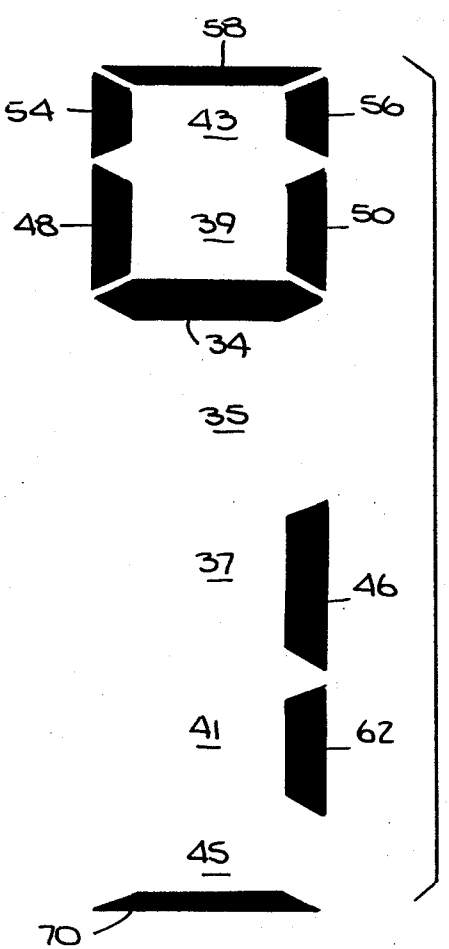
FIGS. 5–11 show the incremental advance of a display constructed according to the invention from "0" to "2"

Referring to FIG. 7 the digit 0 is moving upwardly out of view in a considerably compressed form comprised by segments 34, 48, 50, 54, 56 and 58 of rectangles 43 and 39. The digit 1 is moving towards center scale as a shortened digit comprised of segments 46 and 62 of rectangles 37 and 41. The digits 0 and 1 are entire digits. The top of the digit 2 is just beginning to become visible at the bottom of the display as segment 70. In FIG. 6 rectangles 41, 37, 39 and 43 are energized while rectangles 45 and 35 (represented by their vertical segments) are not energized. Two 7 segment displays are presented by rectangles 41–37 and 39–43 displaying digits 1 and 0.

Figure 8:
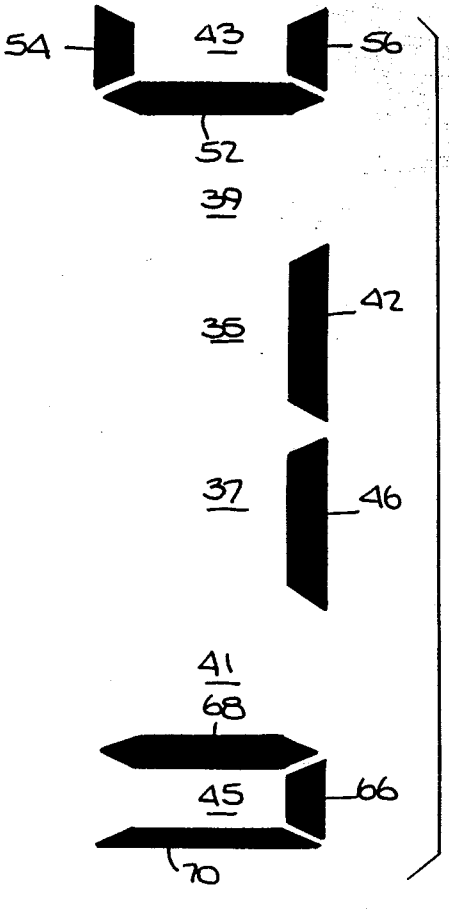

Referring to FIG. 8 the digit 1 is now centered and full sized as indicated by segments 42 and 46 of the central rectangles 35 and 37. The digit 0 has moved upward so that only a small foreshortened bottom portion remains visible in segments 54, 56 and 52 of rectangle 43. At the bottom of the display the top portion of the numeral 2 has begun to become visible in segments 68, 66 and 70 of rectangle 45. Rectangles 45, 37, 35 and 43 are energized. Rectangles 39 and 41 (represented by their vertical segments) are not energized. A single 7 segment digit display is presented in the central rectangles 35 and 37. Half digits are presented by rectangles 43 and 45.

Figure 9:
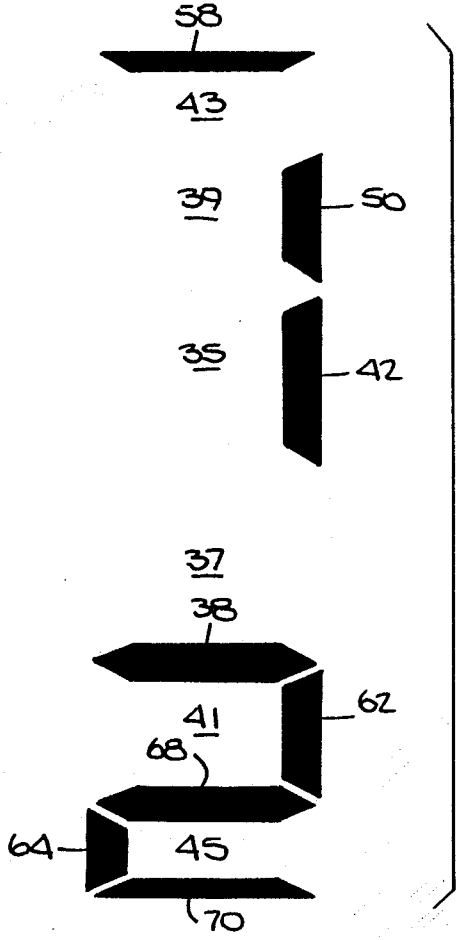

In FIG. 9 the numeral 1 has moved upwardly beyond its midpoint and started to become foreshortened as indicated by segments 42 and 50 of rectangles 35 and 39. The numeral 0 is virtually out of view at the top of the display with only segment 58 remaining. At the bottom of the display the numeral 2 appears to be almost fully on scale but foreshortened as it appears from segments 38, 62, 68, 64 and 70 of rectangles 41 and 45. Rectangles 45, 41, 35 and 39 are energized. Rectangles 37 and 43 (as represented by their vertical segments) are not energized. Two 7 segment digit displays are presented by rectangles 45–41 and 35–39.

Figure 10:
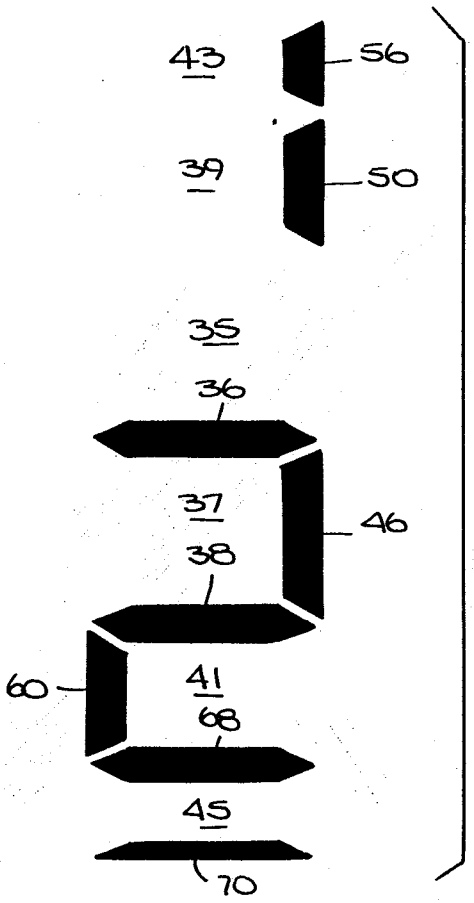

In FIG. 10 the numeral 2 has moved upwardly towards its center position but is still below center and is still foreshortened as indicated by segments 36, 46, 38, 60 and 68 of rectangles 37 and 41. The digit 1 is considerably foreshortened at the top of the display as indicated by segments 56 and 50 of rectangles 39 and 43 as it moves upwardly the numeral 3 has commenced to appear in the display at the bottom in the form of half segment 70. Rectangles 41–37 and 39–43 are energized. Rectangles 45 and 35 (as represented by their vertical segments) are not energized.

Figure 11:
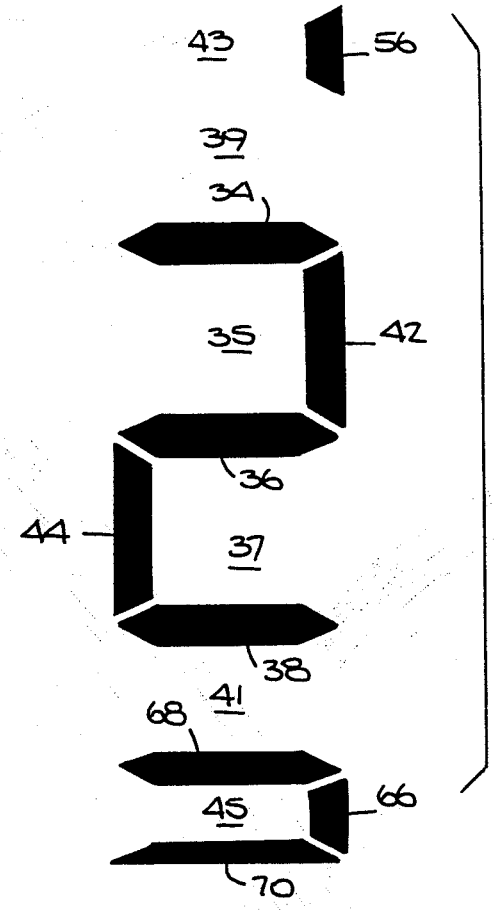

In FIG. 11 the digit 2 is now centered and full sized as indicated by segments 34, 42, 36, 44 and 38 of rectangles 35 and 37. At the top of the display only a lower foreshortened portion of the digit 1 remains visible in segment 56 of rectangles 39 and 43. At the bottom of the display the top half of the numeral 3 in a foreshortened form appears in the form of segments 68, 66 and 70 of rectangle 45. Rectangles 45, 37, 35 and 43 are energized. Rectangles 41 and 39 (represented by their verticle segments) are not energized. A single 7 segment digit display is presented by the central rectangles 35 and 37 and the advance of the digit 2 to center scale is complete.

The progression of energization of the segments from the digit 0 being centered to the digit 2 being centered is presented in tabular form in FIG. 13 indicating the energized segments at each incremental advance. The same progression from center display of digit 0 to center display of digit 2 is presented in tabular form in FIG. 14 illustrating the progressive energization of the indicated rectangles. It will be seen that the sequence is repeated from digit to digit as will be apparent to those skilled in the art.

Figure 4:
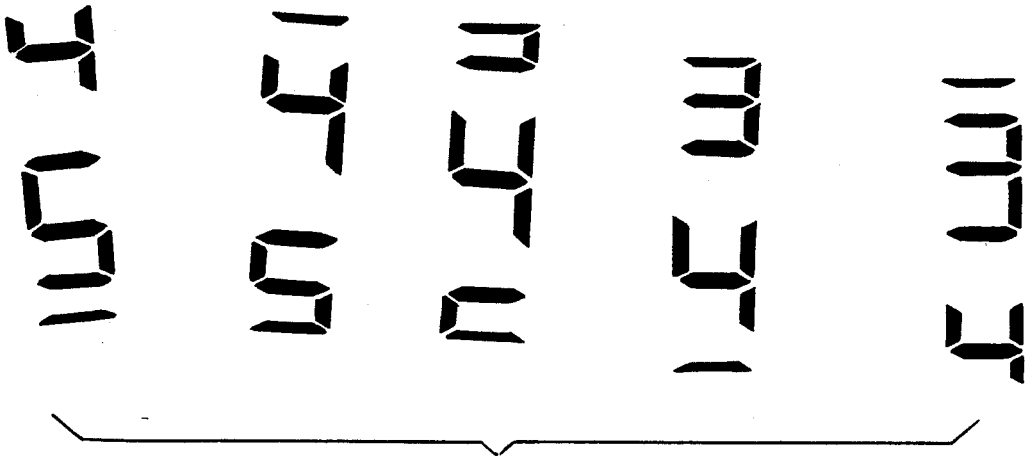
FIG. 4 shows a frame by frame depiction of the advance of the digit "4" in a display constructed according to the invention.

The display 32 illustrated in FIG. 2 is seen to constitute a central 7 segment display having a 7 segment display superimposed thereabove and sharing the segment 34. Similarly a 7 segment display depends therebelow and shares segment 38. The total display 32 contains 19 segments. With such display as described in connection with FIGS. 5–11 and as illustrated in the tabular presentations of FIGS. 13 and 14 the progression from center position for one digit represents a three step increment or decrement from the adjacent digit. The display similarly progresses through the remaining digits from 0 through 9 as will be clear to those skilled in the art. A display by frames illustrating the progression showing the two steps on either side of the digit 4 is illustrated by way of example in FIG. 4. The effect is an analog perception from a digital display wherein a trend or direction of movement may be observed in less than digital increments.

Figure 12:
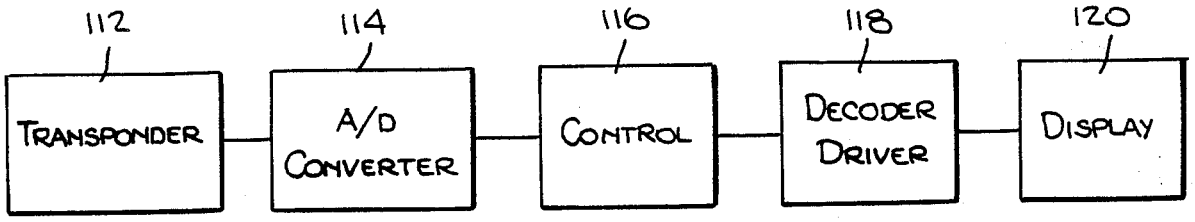
FIG. 12 is a block diagram of the present invention.

Referring to FIG. 12 there is shown a block diagram of a typical apparatus which includes the display of the invention. Thus referring to that Figure there is shown a transponder or transducer 112 which produces an analog voltage or current indicative of the parameter being measured such as automotive speed or aircraft altitude. The transponder 112 is connected to an analog-to-digital (A/D) converter 114 to convert the analog voltage or current to digital form. This signal is then fed to a controller 116 including a clock and suitable microprocessor logic for feeding a decoder/driver 118 to drive the LCD display 120. The display may be comprised of one or more LCD displays of the type illustrated and described in connection with FIGS. 2 and 4–14. In a specific embodiment the display may be incorporated in an aircraft instrument such as illustrated in FIG. 1.

Figure 3:
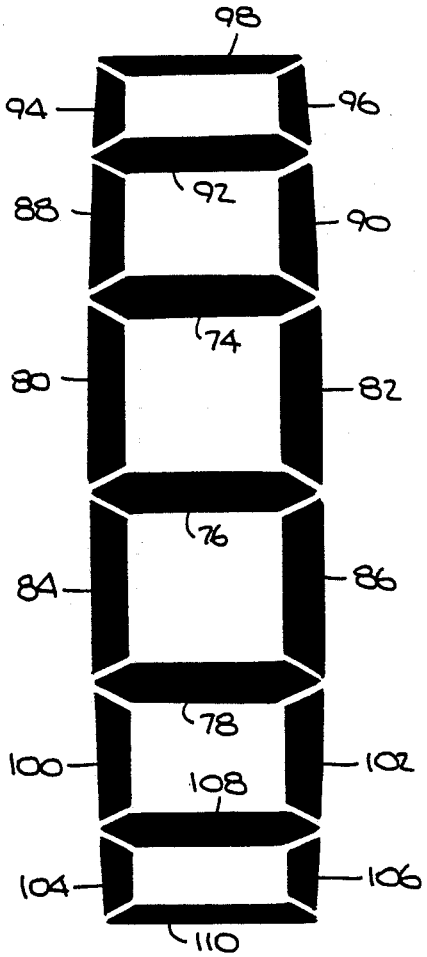
FIG. 3 shows an LCD display segment according to another embodiment of the invention with all segments energized.

The embodiment of the display described in connection with FIG. 2, FIGS. 5–11 and FIG. 4 relies for a three dimensional illusion on foreshortening of the vertical segments of the digits or partial digits displayed. According to another embodiment of the invention this three dimensional illusion may be enhanced as is illustrated by way of example in FIG. 3. Referring to FIG. 3 there is shown a 19 segment display generally similar to that illustrated in and described in connection with FIG. 2. Thus that display comprises segments 74–110 corresponding generally to the segments 34–70 in FIG. 2. In the display of FIG. 3 the central 7 segment display portion comprised of segments 74–86 is identical to the central portion of FIG. 2 comprised of segments 34–46. However the display comprised of the 6 segments 88–98 overlying segment 74 are increasingly compressed in proportion to the distance above the common segment 74. Thus segments 88 and 90 have decreasing widths as they extend upwardly and horizontal segment 92 is shorter than horizontal segment 74. Vertical segments 94 and 96 are also of decreasing width as they extend upward and horizontal segment 98 is shorter than horizontal segment 92.

The lowermost 6 segment portion of the display in FIG. 3 comprised of segments 100–110 is also of decreasing size as it extends down from segment 78 and constitutes a mirror image of the uppermost 6 segment portion comprising segments 88–98 just described. The result of this arrangement is to enhance the optical illusion of a disk or drum by not only foreshortening the upper and lowermost segments vertically but also horizontally on a progressive basis.

It will be apparent from the foregoing that the display of this invention permits the planar presentation of a three dimensional disk or drum type readout with which observers have become so familiar based on years of reliance on that type of display. The invention permits taking advantage of the propensity for observers conditioned in that manner to read trends and sense information in addition to that which would be presented by a simple digital display of the current value of a parameter. This is accomplished with minimal display and circuitry. The result is enhanced communication of information and increased utility of the instrument.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A solid state display device comprising a substantially planar support means having;

(a) multiple energizable display elements disposed on said support means to form substantially rectilinear segments;

(b) said segments being arranged to define multiple trapezoids of substantially rectangular configuration;

(c) said segments including:

(i) a first set of said segments extending lengthwise in a first substantially straight line, (ii) a second set of segments extending lengthwise in a second substantially straight line substantially parallel to said first straight line;

(iii) substantially parallel spaced segments extending lengthwise substantially perpendicular to said first and second straight lines to define said rectangles in a generally ladder-like configuration;

(d) said segments defining a central pair of adjacent rectangles having a first common segment forming a common side of each said adjacent rectangle, (e) four segments of said central rectangles lying in said substantially parallel substantially straight lines;

(f) a third set of segments of said display additional to those forming said central pair of adjacent rectangles forming additional rectangles in excess of one at opposite sides of said central pair;

(g) said additional rectangles including:

(i) first additional rectangles disposed above and below said central rectangles with each having a segment of said third set of segments forming a common side with said central rectangles, (ii) second additional rectangles disposed above and below said first additional rectangles with each having a segment of said third set of segments forming a common side with said first additional rectangles, (h) said four segments of said central rectangles lying in said substantially straight lines being of substantially the same length, (i) the segments of said first additional rectangles lying in said substantially straight lines being of a length less than the length of said four segments of said central rectangles lying in said straight lines;

(j) the segments of said second additional rectangles lying in said substantially straight lines being of a length less than the length of the segments lying in said straight lines in said first additional rectangles;

(k) the segments in each adjacent pair of rectangles being selectively energizable to display digits, (1) said digits having:

(i) a first height in the direction of said straight lines when said digit is formed by the segments of said central pair of rectangles, (ii) a second height when said digit is formed by a central rectangle and a first additional rectangle, and (iii) a third height when said digit is formed by a first additional rectangle and a second additional rectangle, (iv) said third height being less than said second height and said second height being less than said first height.

2. A solid state display device according to claim 1 wherein the common segments between the first and second additional rectangles have a thickness less than the thickness of the common segment in said central rectangles.

3. A solid state display device according to claim 2 wherein the outermost segments of said third set of segments in said second additional rectangles have a thickness less than the thickness of the common segments between said first and second additional rectangles.

4. A solid state display device according to claim 1 wherein the common segments between the first and second additional rectangles have a length less than the length of the common segments between the central rectangles and the first additional rectangles.

5. A solid state display device according to claim 4 wherein the outermost segments of said third set of segments in said second additional rectangles have a length less than the lengths of the common segments between said first and second additional rectangles.

6. A solid state display device according to claim 4 including an opaque soreen overlying the display device and having at least one opening therein framing the rectangles formed by said segments.

7. A solid state display device according to claim 5 wherein the segments of the first and second set in said first and second additional rectangles have a thickness which decreases as said segments extend away from said central angles.

8. A solid state display device according to claim 1 wherein the segments of the first and second sets in said first and second additional rectangles have a thickness which decreases as said segments extend away from said central rectangles.

9. A solid state display device according to claim 1 wherein each pair of said rectangles comprises a 7 segment LCD display.

10. A solid state display device according to claim 1 including control, decoder and driver means to advance said display device from one digit to the next in multiple incremental steps.

11. A dichroic LCD display device comprising:

(A) a substantially planar support means having thereon multiple 7 segment digit displays having horizontal segments which in combination with vertical segments provide at least 6 rectangular arrays together having at least 5 common horizontal segments;

(B) said rectangular segment arrays comprising a central pair of rectangles having vertical segments of equal length;

(C) first additional rectangles disposed above and below said central rectangles and having vertical segments with a length less than the length of said vertical segments in said central rectangles;

(D) second additional rectangles disposed above and below said first additional rectangles and having vertical segments having a length less than the length of the vertical segments in said first additional rectangles;

(E) the segments in each adjacent pair of rectangles being selectively energizable to display digits, said digits having a first vertical height when formed by the segments of said central pair of rectangles, a second vertical height then said digit is formed by a central rectangle and a first additional rectangle, and a third vertical height when said digit is formed by a first additional rectangle and a second additional rectangle; said third height being less than said second height and said second height being less than said first height.

* * * * *

UNITED STATES PATENT AND TRADEMARK OFFICE

CERTIFICATE OF CORRECTION

PATENT NO. : 4,918,428

DATED : April 17, 1990

INVENTOR(S) : Joseph Bebel

It is certified that error appears in the above-identified patent and that said Letters Patent is hereby corrected as shown below:

TITLE PAGE:
In the title, delete "TREAD" and add -- TREND --.

Signed and Sealed this

Sixteenth Day of July, 1991

*Attest:*

HARRY F. MANBECK, JR.

*Attesting Officer*

*Commissioner of Patents and Trademarks*